US008188661B2

(12) United States Patent
Hashimoto et al.

(10) Patent No.: US 8,188,661 B2
(45) Date of Patent: May 29, 2012

(54) PLASMA DISPLAY PANEL CAPABLE OF DISPLAYING A VIDEO HAVING HIGH BRIGHTNESS WHILE REQUIRING A LOW DRIVING VOLTAGE

(75) Inventors: Jun Hashimoto, Osaka (JP); Masashi Gotou, Osaka (JP); Yasuyuki Noguchi, Hyogo (JP)

(73) Assignee: Panasonic Corporation, Osaka (JP)

( * ) Notice: Subject to any disclaimer, the term of this patent is extended or adjusted under 35 U.S.C. 154(b) by 114 days.

(21) Appl. No.: 12/674,518

(22) PCT Filed: Sep. 28, 2009

(86) PCT No.: PCT/JP2009/004903

§ 371 (c)(1),
(2), (4) Date: Feb. 22, 2010

(87) PCT Pub. No.: WO2010/035487

PCT Pub. Date: Apr. 1, 2010

(65) Prior Publication Data

US 2011/0248629 A1 Oct. 13, 2011

(30) Foreign Application Priority Data

Sep. 29, 2008 (JP) ..... 2008-250121
Jan. 9, 2009 (JP) ..... 2009-003208

(51) Int. Cl.
*H01J 17/49* (2012.01)

(52) U.S. Cl. ..... 313/582; 313/584; 313/585; 313/586; 313/587; 345/60; 445/24

(58) Field of Classification Search ..... 313/582–587
See application file for complete search history.

(56) References Cited

U.S. PATENT DOCUMENTS 7,880,387 B2 * 2/2011 Ohtoh et al. ..... 313/587
2008/0085375 A1 4/2008 Kim et al.

(Continued)

FOREIGN PATENT DOCUMENTS

JP 8-236028 9/1996

(Continued)

OTHER PUBLICATIONS

International Search Report issued Oct. 27, 2009 in International (PCT) Application No. PCT/JP2009/004903.

*Primary Examiner* — Sikha Roy
(74) *Attorney, Agent, or Firm* — Wenderoth, Lind & Ponack, L.L.P.

(57) ABSTRACT

A plasma display panel (PDP), which is capable of performing a display with a high brightness and having a low power consumption, includes a front panel having display electrodes formed, a dielectric layer covering the display electrodes, and a protective layer formed on the dielectric layer. Further, the PDP includes rear panel having address electrodes formed along a direction intersecting the display electrodes, and barrier ribs. The front and rear panels form, therebetween, a discharge space portioned by the barrier ribs and filled with discharge gas. A protective layer is formed of a metal oxide of MgO and CaO, such that an X-ray diffraction analysis on a surface of the protective layer indicates that the metal oxide has a peak between a diffraction angle where a peak of MgO occurs and a diffraction angle where a peak of CaO occurs along an identical orientation of the MgO peak.

3 Claims, 6 Drawing Sheets

U.S. PATENT DOCUMENTS

| | | | | |
|---|---|---|---|---|
| 2009/0140652 | A1 | 6/2009 | Fukui et al. | |
| 2009/0146566 | A1 | 6/2009 | Fukui et al. | |
| 2009/0167176 | A1 | 7/2009 | Fukui et al. | |
| 2010/0117532 | A1* | 5/2010 | Ishino et al. | 313/582 |

FOREIGN PATENT DOCUMENTS

| | | |
|---|---|---|
| JP | 10-334809 | 12/1998 |
| JP | 11-339665 | 12/1999 |
| JP | 2002-260535 | 9/2002 |
| JP | 2005-264272 | 9/2005 |
| JP | 2006-59779 | 3/2006 |
| JP | 2007-141485 | 6/2007 |
| JP | 2007-317487 | 12/2007 |
| JP | 2008-27924 | 2/2008 |
| JP | 2008-91074 | 4/2008 |
| JP | 2008-98139 | 4/2008 |
| WO | 2007/126061 | 11/2007 |

* cited by examiner

PLASMA DISPLAY PANEL CAPABLE OF DISPLAYING A VIDEO HAVING HIGH BRIGHTNESS WHILE REQUIRING A LOW DRIVING VOLTAGE

TECHNICAL FIELD

The present invention relates to plasma display panels to be used in display devices.

BACKGROUND ART

A plasma display panel (hereinafter referred to simply as a PDP) allows achieving a high definition display and a large-size screen, so that television receivers (TV) with large screens of as large as 100 inches diagonal length can be commercialized by using the PDP. In recent years, use of the PDPs in high-definition TVs, which need more than doubled scanning lines than conventional NTSC method, has progressed. The PDP has been demanded to further reduce the power consumption in order to meet the energy-saving trend, and the PDP free from lead (Pb) has been also required in order to contribute to environment protection.

The PDP is basically formed of a front panel and a rear panel. The front panel comprises the following structural elements:

- a glass substrate made of sodium-borosilicate-based float glass;
- display electrodes, formed of striped transparent electrodes and bus electrodes, formed on a principal surface of the glass substrate,
- a dielectric layer covering the display electrodes and working as a capacitor; and
- a protective layer made of magnesium oxide (MgO) and formed on the dielectric layer.

The rear panel comprises the following structural elements:

- a glass substrate;
- striped address electrodes formed on a principal surface of the glass substrate,
- a primary dielectric layer covering the address electrodes;
- barrier ribs formed on the primary dielectric layer; and
- phosphor layers formed between each one of the barrier ribs for emitting lights in red, green, and blue respectively.

The front panel confronts the rear panel such that its electrode-mounted surface confronts an electrode-mounted surface of the rear panel, and peripheries of both the panels are sealed in an airtight manner to form a discharge space between these two panels, and the discharge space is partitioned by the barrier ribs. The discharge space is filled with discharge gas of Neon (Ne) and Xenon (Xe) at a pressure ranging from 400 Torr (53300 Pa) to 600 Torr (80000 Pa). The PDP allows displaying a color video this way: Voltages of video signals are selectively applied to the display electrodes for discharging, thereby producing ultra-violet rays, which excite the phosphor layers for each color, so that colors in red, green, and blue are emitted, whereby a color video can be displayed.

The PDP discussed above is driven, in general, by a driving method which has an initializing period for adjusting wall charges into an easy-addressable state, an address period for carrying out address-discharge in response to input video signals, and a sustain period for displaying a video by generating sustain-discharge in a discharge space where an address has been done. A time span formed of the foregoing periods combined together is referred to as a subfield, and this subfield is repeated several times within one field corresponding to one frame of a video, thereby achieving a gray scale of the PDP.

The protective layer formed on the dielectric layer of the front panel of the foregoing PDP is expected to carry out the two major functions: (1) protecting the dielectric layer from ion impact caused by the discharge, and (2) emitting primary electrons for generating address discharges. The protection of the dielectric layer from the ion impact plays an important role for preventing a discharge voltage from rising, and the emission of primary electrons for generating the address discharges also plays an important role for eliminating an erroneous address discharge because the error causes flickers on videos.

To reduce the flickers on videos, the number of primary electrons emitted from the protective layer should be increased. For this purpose, impurities are added to magnesium oxide (MgO), or particles of MgO are formed on the protective layer made of MgO. These instances are disclosed in, e.g. Patent Literatures 1, 2, 3, 4 and 5.

In recent years, a higher definition has been required to TV receivers. The market thus requires the PDP to be manufactured at a lower cost, to consume a lower power, and to be a full HD (high-definition, 1920×1080 pixels, and progressive display) with a higher brightness. The characteristics of emitting electrons from the protective layer determine the picture quality, so that it is vital for controlling the electron emission characteristics.

To be more specific, a video of higher definition needs a greater number of pixels to be addressed although a time for one field is kept as it has been, so that a width of a pulse, within an address period of a subfield, for applying a voltage to address electrodes should be narrowed. However, a time lag is present between a rise of a voltage pulse and a discharge into the discharge space. This time lag is referred to as a discharge delay. A narrower pulse width thus lowers a probability of ending a discharge within an address period. As a result, a defective lighting occurs and flickers which degrade a video quality are produced.

A partial pressure of xenon (Xe) can be increased for improving an efficiency of light emission produced by the discharge so that the power consumption can be lowered. However, a greater discharge voltage invites a greater discharge delay, thereby incurring a defective lighting which degrades a video quality.

As discussed above, the progress of PDP of higher definition and lower power consumption should be accompanied with the following two measures simultaneously: (1) avoid increasing a discharge voltage, and (2) decrease defective lightings to improve a video quality.

A protective layer added with impurities has been tested whether or not this addition can improve the electron-emission characteristics; however, in a case where the characteristics can be improved, electric charges are stored on the surface of the protective layer to be used as a memory function. The number of electric charges decreases greatly with time, i.e. an attenuation rate becomes greater. To overcome this attenuation, measures is needed such as increment in an applied voltage.

On the other hand, forming the crystal particles of MgO on the protective layer made of MgO allows reducing a discharge delay, thereby lowering the number of defective lightings; however, the discharge voltage cannot be lowered.

The present invention addresses the foregoing problems, and aims to provide a PDP which can display a video of a higher brightness and yet can be driven at a lower voltage.

Patent Literature 1: Unexamined Japanese Patent Application Publication No. 2002-260535

Patent Literature 2: Unexamined Japanese Patent Application Publication No. H11-339665

Patent Literature 3: Unexamined Japanese Patent Application Publication No. 2006-59779

Patent Literature 4: Unexamined Japanese Patent Application Publication No. 08-236028

Patent Literature 5: Unexamined Japanese Patent Application Publication No. H10-334809

DISCLOSURE OF INVENTION

The PDP of the present invention comprises the following structural elements:

a first substrate including display electrodes formed on a board, a dielectric layer covering the display electrodes, and a protective layer formed on the dielectric layer; and a second substrate opposing to the first substrate to form a discharge space which is filled with discharge gas, and including address electrodes formed along the direction intersecting with the display electrodes, and barrier ribs partitioning the discharge space. The protective layer is made of metal oxide which is formed of magnesium oxide (MgO) and calcium oxide (CaO). This metal oxide has the following properties:

(1) When the surface of the protective layer undergoes X-ray diffraction analysis, the metal oxide has a peak between a diffraction angle where a peak of MgO occurs and a diffraction angle where a peak of CaO, disposed along an identical orientation of MgO, occurs.

(2) a density of calcium (Ca) is within a range of 5 atomic %-25 atomic % (inclusive), and (3) the metal oxide has a peak indicating crystal orientation of (111) plane.

The foregoing structure allows the PDP to be driven with a lower voltage although the secondary emission characteristics in the protective layer are improved, and a partial pressure of Xenon gas is increased in order to raise the brightness. As a result, the PDP driven with a higher voltage and displaying a video of higher brightness can be obtained.

DETAILED DESCRIPTION OF PREFERRED EMBODIMENTS

An exemplary embodiment of the present invention is demonstrated hereinafter with reference to the accompanying drawings.

Embodiment

Figure 1:
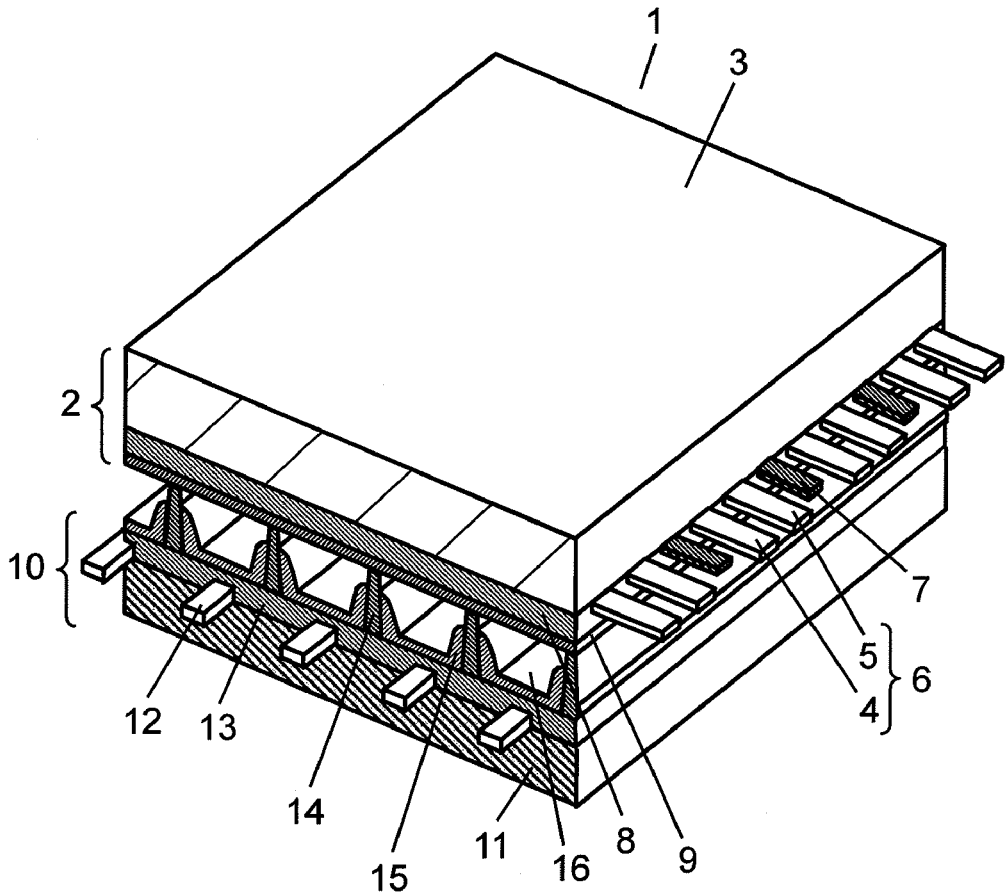
FIG. 1 shows a perspective view illustrating a structure of a PDP in accordance with an embodiment of the present invention.

FIG. 1 shows a perspective view illustrating a structure of PDP 1 in accordance with the embodiment of the present invention. PDP 1 is basically structured similarly to a PDP of AC surface discharge type generally used. As shown in FIG. 1, PDP 1 is formed of a first substrate (hereinafter referred to as front panel 2) including front glass substrate 3, and a second substrate (hereinafter referred to as rear panel 10) including rear glass substrate 11. Front panel 2 and rear panel 10 confront each other and the peripheries thereof are airtightly sealed with sealing agent such as glass frit, thereby forming discharge space 16, which is filled with discharge gas such as Ne and Xe at a pressure falling within a range between 400 Torr (53300 Pa) and 600 Torr (8000 Pa).

Multiple pairs of belt-like display electrodes 6, each of which is formed of scan electrode 4 and sustain electrode 5, are placed in parallel with multiple black stripes (lightproof layers) 7 on front glass substrate 3 of front panel 2. Dielectric layer 8, retaining electric charges for working as a capacitor, is formed on front glass substrate 3 such that layer 8 can cover display electrodes 6 and lightproof layers 7. On top of that, protective layer 9 is formed on dielectric layer 8.

Multiple belt-like address electrodes 12 are placed in parallel with one another on rear glass substrate 11 of rear panel 10, and they are placed along a direction intersecting at right angles with scan electrodes 4 and sustain electrodes 5 formed on front panel 2. Primary dielectric layer 13 covers those address electrodes 12. Barrier ribs 14 having a given height are formed on primary dielectric layer 13 placed between respective address electrodes 12, and barrier ribs 14 partition discharge space 16. Phosphor layers 15 are applied onto each one of the grooves formed between each one of barrier ribs 14. Phosphor layers 15 emit light in red, blue, and green with radiation of ultraviolet rays thereto. A discharge space is formed at a junction point where scan electrode 14, sustain electrode 15 and address electrode 12 intersect with one another. The discharge spaces having phosphor layers 15 of red, blue, and green respectively are placed along display electrodes 6, and these spaces work as pixels for color display.

Figure 2:
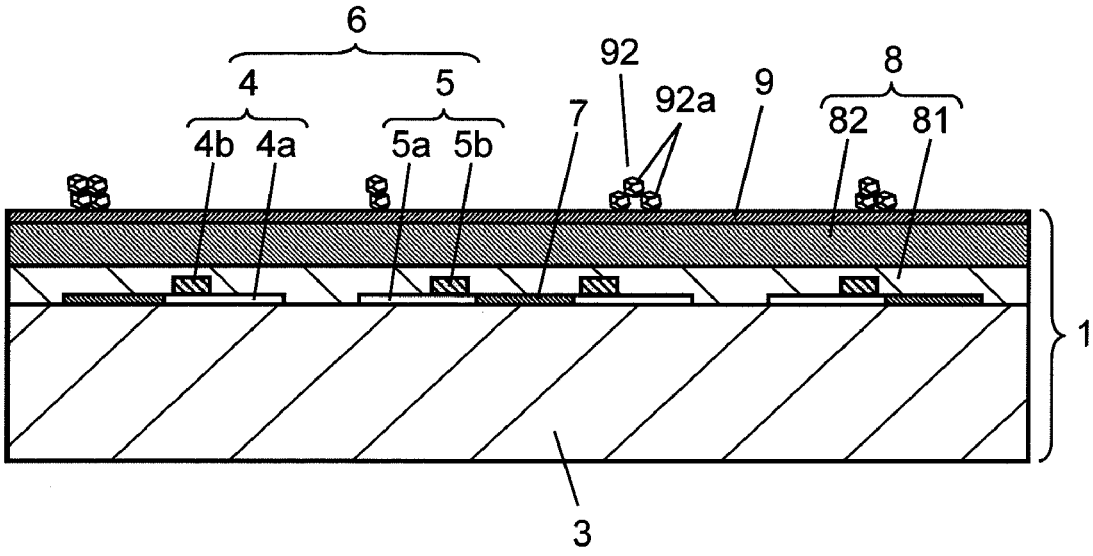
FIG. 2 shows a sectional view illustrating a structure of a front panel of the PDP.

FIG. 2 shows a sectional view illustrating a structure of front panel 2 of PDP 1 in accordance with this embodiment. FIG. 2 shows front panel 2 upside down from the one shown in FIG. 1. As shown in FIG. 2, display electrodes 6 formed of scan electrodes 4 and sustain electrodes 5 are patterned on front glass substrate 3 manufactured by the float method. Lightproof layer 7 is also patterned together with display electrodes 6 on substrate 3. Scan electrode 4 and sustain electrode 5 are respectively formed of transparent electrodes 4*a*, 5*a* made of indium tin oxide (ITO) or tin oxide ($SnO_2$) and metal bus electrodes 4*b*, 5*b* formed on transparent electrodes 4*a*, 5*a*. Metal bus electrodes 4*b*, 5*b* give electrical conductivity to transparent electrodes 4*a*, 5*a* along the longitudinal direction of electrodes 4*a*, 5*a*, and they are made of conductive material of which chief ingredient is silver (Ag).

Dielectric layer 8 is formed of at least two layers, i.e. first dielectric layer 81 that covers transparent electrodes 4*a*, 5*a*, metal bus electrodes 4*b*, 5*b* and light proof layer 7 formed on front glass substrate 3, and second dielectric layer 82 formed on first dielectric layer 81. Protective layer 9 is formed on second dielectric layer 82.

Protective layer 9 is made of the metal oxide formed of MgO and CaO, and on top of that, aggregated particles 92 are attached onto protective layer 9. Each one of aggregated particles 92 is formed by aggregating multiple crystal particles 92 of MgO.

Next, a method of manufacturing PDP 1 discussed above is demonstrated hereinafter. First, form scan electrodes 4, sustain electrodes 5, and lightproof layers 7 on front glass substrate 3. Scan electrode 4 and sustain electrode 5 are respectively formed of transparent electrodes 4*a*, 5*a* and metal bus electrodes 4*b*, 5*b*. These transparent electrodes 4*a*, 5*a*, and metal bus electrodes 4*b*, 5*b* are patterned by a photo-lithography method. Transparent electrodes 4*a*, 5*a* are formed by using, e.g. a thin-film process, and metal bus electrodes 4*b*, 5*b* are made by firing the paste containing silver (Ag) at a given temperature before the paste is hardened. Lightproof layer 7 is made by screen-printing the paste containing black pigment, or by forming the black pigment on the entire surface of the glass substrate, and then patterning the pigment by the photolithography method before the paste is fired.

Next, apply dielectric paste onto front glass substrate 3 by a die-coating method such that the paste can cover scan electrodes 4, sustain electrodes 5, and lightproof layers 7, thereby forming a dielectric paste layer (dielectric material layer, not shown). Then leave front glass substrate 3, on which dielectric paste is applied, for a given time as it is, so that the surface of the dielectric paste is leveled to be flat. Then fire and harden the dielectric paste layer for forming dielectric layer 8 which covers scan electrodes 4, sustain electrodes 5 and lightproof layers 7. The dielectric paste is a kind of paint containing binder, solvent, and dielectric material such as glass powder.

Next, form protective layer 9 on dielectric layer 8. In this embodiment, protective layer 9 is made of the metal oxide formed of MgO and CaO, and is manufactured by a thin-film deposition method using the pellets made of MgO only or CaO only or the pellets formed by mixing these materials. The thin-film deposition method includes, e.g. electron-beam evaporation method, sputtering method, ion-plating method. These methods are widely known in the industry. For instance, the sputtering method uses a pressure of 1 Pa as a practical upper limit, and the electron-beam evaporation method uses a pressure of 0.1 Pa as a practical upper limit.

The atmosphere during the deposition of protective layer 9 should be an airtight state isolated from the outside in order to prevent water or impurity from attaching to protective layer 9. In this airtight state the atmosphere is adjusted so that protective layer 9 formed of the metal oxide, which has a given electron-emission characteristics, can be formed.

Next, aggregated particle 92 to be attached onto protective layer 9 and formed by aggregating crystal particles 92*a* of MgO is described hereinafter. Crystal particles 92*a* are manufactured by the following vapor-phase synthesizing method or the precursor firing method.

The vapor-phase synthesizing method heats magnesium metal material having the purity of over 99.9% in the atmosphere filled with inert gas, and then a small amount of oxygen is supplied into the atmosphere to directly oxidize the magnesium, thereby manufacturing crystal particles 92*a* of MgO.

The precursor firing method fires the precursor of MgO uniformly at 700° C. or higher than 700° C., and then cools it slowly for obtaining crystal particles 92*a* of MgO. The precursor can be at least one of the compounds selected from the group consisting of $Mg(OR)_2$, $MG(acac)_2$, $Mg(OH)_2$, $MgCO_2$, $MgCl_2$, $MgSO_4$, $Mg(NO_3)_2$, and $MgC_2O_4$. Although some selected compound takes a hydration form, this hydrated compound can be also used.

These compounds are adjusted such that the purity of MgO can be not less than 99.95%, or more preferably, not less than 99.98%, because if these compounds contain impurity elements, such as some alkaline metal, boron (B), silicon (Si), iron (Fe), aluminum (Al), more than a certain amount, useless adhesion between particles or sintering is produced during the heat treatment. These impurities adversely affect the production of highly crystalline crystal particles 92*a* of MgO. It is thus necessary to adjust the precursor in advance by removing the impurity elements.

Disperse crystal particles 92*a* of MgO thus obtained through one of the foregoing methods into solvent, then spray the surface of protective layer with the resultant fluid-dispersion by a spraying method, screen printing method, or electrostatic coating method. Protective layer 9 then undergoes the steps of drying and firing for removing the solvent, whereby aggregated particles 92, each one of particles 92 is formed by aggregating multiple crystal particles 92*a* of MgO, are fixed on the surface of protective layer 9.

Scan electrodes 4, sustain electrodes 5, lightproof layers 7, dielectric layer 8 and protective layer 9 are formed on front glass substrate 3 through the series of processes discussed above, whereby front panel 2 is completed.

Rear panel 10 is formed this way: First, form a material layer (not shown), which is a structural element of address electrode 12, by screen-printing the paste containing silver (Ag) onto rear glass substrate 11, or by patterning with the photolithography method a metal film which is formed in advance on the entire surface of rear glass substrate 11. Then fire the material layer at a given temperature, thereby forming address electrodes 12. Next, form a dielectric paste layer on rear glass substrate 11, on which address electrodes 12 are formed, by applying dielectric paste onto substrate 11 with the die-coating method such that the layer can cover address electrodes 12. Then fire the dielectric paste layer for forming primary dielectric layer 13. The dielectric paste is a kind of paint which contains dielectric material, such as glass powder, binder and solvent.

Next, apply the paste containing the material for barrier rib onto primary dielectric layer 13, and pattern the paste into a given shape, thereby forming a barrier-rib layer (not shown). Then fire this barrier-rib layer at a given temperature for forming barrier ribs 14. The photolithography method or a sand-blasting method can be used for patterning the paste applied onto primary dielectric layer 13. Next, apply the phosphor paste containing phosphor material onto primary dielectric layer 13 surrounded by barrier ribs 14 adjacent to one another and also onto lateral walls of barrier ribs 14. Then fire the phosphor paste for forming phosphor layer 15. The foregoing steps allow completely forming rear panel 10, including the predetermined structural elements, on rear glass substrate 11.

Front panel 2 and rear panel 10 discussed above are placed confronting each other such that scan electrodes 4 intersect with address electrodes 12 at right angles, and the peripheries of panel 2 and panel 10 are sealed with glass frit to form discharge space 16 therebetween, and space 16 is filled with discharge gas including Ne, Xe. PDP 1 is thus completed.

First dielectric layer 81 and second dielectric layer 82 forming dielectric layer 8 of front panel 2 are detailed hereinafter. The dielectric material of first dielectric layer 81 is formed of the following compositions: bismuth oxide ($Bi_2O_3$) in 20-40 wt %; at least one composition in 0.5-12 wt % selected from the group consisting of calcium oxide (CaO), strontium oxide (SrO), and barium oxide (BaO); and at least one composition in 0.1-7 wt % selected from the group consisting of molybdenum oxide ($MoO_3$), tungstic oxide ($WO_3$), cerium oxide ($CeO_2$), and manganese dioxide ($MnO_2$).

At least one composition in 0.1-7 wt % selected from the group consisting of copper oxide (CuO), chromium oxide ($Cr_2O_3$), cobalt oxide ($Co_2O_3$), vanadium oxide ($V_2O_7$), and antimony oxide ($Sb_2O_3$) can replace the foregoing molybdenum oxide ($MoO_3$), tungstic oxide ($WO_3$), and cerium oxide ($CeO_2$), manganese dioxide ($MnO_2$).

Other than the foregoing compositions, the following compositions free from lead (Pb) can be contained in the dielectric material: zinc oxide (ZnO) in 0-40 wt %; boron oxide ($B_2O_3$) in 0-35 wt %; silicon dioxide ($SiO_2$) in 0-15 wt %, and aluminum oxide ($Al_2O_3$) in 0-10 wt %.

The dielectric material containing the foregoing compositions is grinded by a wet jet mill or a ball mill into powder of which average particle diameter is 0.5 μm-2.5 μm. Next, this dielectric powder in 55-70 wt % and binder component in 30-45 wt % are mixed with a three-roll mill, so that the paste for the first dielectric layer to be used in the die-coating or the printing can be produced.

The binder component is formed of terpinol or butyl carbitol acetate which contains ethyl-cellulose or acrylic resin in 1 wt %-20 wt %. The paste can contain, upon necessity, plasticizer such as dioctyl phthalate, dibutyl phthalate, triphenyl phosphate, tributyl phosphate, and dispersant such as glycerop mono-oleate, sorbitan sesquio-leate, homogenol (a product of Kao Corporation), alkyl-allyl based phosphate for improving the printing performance.

Next, the paste for the first dielectric layer discussed above is applied to front glass substrate 3 by the die-coating method or the screen-printing method such that the paste covers display electrodes 6, before the paste is dried. The paste is then fired at 575-590° C. a little bit higher than the softening point of the dielectric material, thereby forming first dielectric layer 81.

Second dielectric layer 82 is detailed hereinafter. The dielectric material of second dielectric layer 82 is formed of the following compositions: bismuth oxide ($Bi_2O_3$) in 11-20 wt %; at least one composition in 1.6-21 wt % selected from the group consisting of calcium oxide (CaO), strontium oxide (SrO), and barium oxide (BaO); and at least one composition in 0.1-7 wt % selected from the group consisting of molybdenum oxide ($MoO_3$), tungstic oxide ($WO_3$), and cerium oxide ($CeO_2$).

At least one composition in 0.1-7 wt % selected from the group consisting of copper oxide (CuO), chromium oxide ($Cr_2O_3$), cobalt oxide ($Co_2O_3$), vanadium oxide ($V_2O_7$), antimony oxide ($Sb_2O_3$), and manganese dioxide ($MnO_2$) can replace the foregoing molybdenum oxide ($MoO_3$), tungstic oxide ($WO_3$), and cerium oxide ($CeO_2$).

Other than the foregoing compositions, the following compositions free from lead (Pb) can be contained in the dielectric material: zinc oxide (ZnO) in 0-40 wt %; boron oxide ($B_2O_3$) in 0-35 wt %; silicon dioxide ($SiO_2$) in 0-15 wt %, and aluminum oxide ($Al_2O_3$) in 0-10 wt %.

The dielectric material containing the foregoing compositions is grinded by the wet jet mill or the ball mill into powder of which particle diameter is 0.5 μm-2.5 μm. Next, this dielectric powder in 55-70 wt % and binder component in 30-45 wt % are mixed with a three-roll mill, so that the paste for the second dielectric layer to be used in the die-coating or the printing can be produced. The binder component is formed of terpinol or butyl carbitol acetate which contains ethyl-cellulose or acrylic resin in 1 wt %-20 wt %. The paste can contain, upon necessity, plasticizer such as dioctyl phthalate, dibutyl phthalate, triphenyl phosphate, tributyl phosphate, and dispersant such as glycerop mono-oleate, sorbitan sesquio-leate, homogenol (a product of Kao Corporation), alkyl-allyl based phosphate for improving the printing performance.

Then the paste of the second dielectric layer discussed above is applied onto first dielectric layer 81 by the die-coating method or the screen-printing method before the paste is dried. The paste is then fired at 550-590° C. a little bit higher than the softening point of the dielectric material.

The film thickness of dielectric layer 8 (total thickness of first layer 81 and second layer 82) is preferably not greater than 41 μm in order to maintain the visible light transmission. First dielectric layer 81 contains a greater amount (20-40 wt %) of bismuth oxide ($Bi_2O_3$) than the amount thereof contained in second dielectric layer 82 in order to suppress the reaction of metal bus electrodes 4*b*, 5*b* with silver (Ag), so that first layer 81 is obliged to have a visible light transmittance lower than that of second layer 82. To overcome this problem, first layer 81 is formed thinner than second layer 82.

If second dielectric layer 82 contains bismuth oxide ($Bi_2O_3$) not greater than 11 wt %, it resists to be colored; however, air bubbles tend to occur in second layer 82, so that the content of not greater than 11 wt % is undesirable. On the other hand, if the content exceeds 40 wt %, second layer 82 tends to be colored, which incurs a decrease in the light transmittance.

A brightness of PDP advantageously increases and a discharge voltage also advantageously lowers at a thinner film thickness of dielectric layer 8, so that the film thickness is desirably set as thin as possible insofar as the dielectric voltage is not lowered. Considering these conditions, the film thickness of dielectric layer 8 is set not greater than 41 μm in this embodiment. To be more specific, first dielectric layer 81 has a thickness of 5-15 μm and second dielectric layer 82 has a thickness of 20-36 μm.

PDP 1 thus manufactured invites little coloring (yellowing) in front glass substrate 3 although display electrodes 6 are formed of silver (Ag), and yet, its dielectric layer 8 has no air bubbles, so that dielectric layer 8 excellent in withstanding voltage performance is achievable.

The dielectric materials discussed above allow first dielectric layer 81 of PDP 1 to have less yellowing or air bubbles. The reason is discussed hereinafter. It is known that the addition of molybdenum oxide ($MoO_3$) or tungstic oxide ($WO_3$) to the dielectric glass containing bismuth oxide ($Bi_2O_3$) tends to produce such chemical compounds as $Ag_2MoO_4$, $Ag_2Mo_2O_7$, $Ag_2Mo_4O_{13}$, $Ag_2WO_4$, $Ag_2W_2O_7$, $Ag_2W_4O_{13}$ at a temperature as low as 580° C. or lower than 580° C.

Since dielectric layer 8 is fired at a temperature between 550° C. and 590° C. in this embodiment, silver ions ($Ag^+$) diffused in dielectric layer 8 during the firing react with molybdenum oxide ($MoO_3$), tungstic oxide ($WO_3$), cerium oxide ($CeO_2$), or manganese oxide ($MnO_2$) contained in dielectric layer 8, thereby producing a stable chemical compound. In other words, silver ions ($Ag^+$) are stabilized without having undergone the reduction, so that the silver ions are not aggregated, nor form colloid. A smaller amount of oxygen is thus produced because the colloid formation accompanies the oxygen production. As a result, the smaller amount of air bubbles is produced in dielectric layer 8.

To use the foregoing advantage more effectively, it is preferable for the dielectric glass containing the bismuth oxide ($Bi_2O_3$) to contain molybdenum oxide ($MoO_3$), tungstic oxide ($WO_3$), cerium oxide ($CeO_2$), or manganese oxide ($MnO_2$) at a content not less than 0.1 wt %, and it is more preferable that the content should be in the range from not smaller than 0.1 wt % to not greater than 7 wt %. The content less than 0.1 wt % will reduce the yellowing in only little amount, and the content over 7 wt % will produce coloring to the glass, so that the content out of the foregoing range is unfavorable.

To be more specific, first dielectric layer 81 placed closely to metal bus electrodes 4*b*, 5*b* made of Ag can reduce the yellowing and the air-bubbles, and second dielectric layer 82 placed on first dielectric layer 81 allows the light to transmit at a higher light transmittance. As a result, dielectric layer 8 as a whole allows the PDP to invite extremely smaller amounts of the air bubbles and the yellowing, and yet, allows the PDP to have the higher light transmittance.

Protective layer 9 in accordance with this embodiment is detailed hereinafter. Protective layer 9 is made of metal oxide which is formed of MgO and CaO by using the electron-beam evaporation method. This metal oxide has the following properties:

(1) When the surface of protective layer 9 undergoes X-ray diffraction analysis, a peak is present between a diffraction angle where a peak of MgO occurs and a diffraction angle where a peak of CaO, disposed along an identical plane orientation of MgO, occurs and (2) a density of calcium (Ca) is within a range of 5 atomic %-25 atomic % (inclusive), and (3) the metal oxide has a peak indicating crystal orientation of (111) plane.

Figure 3:
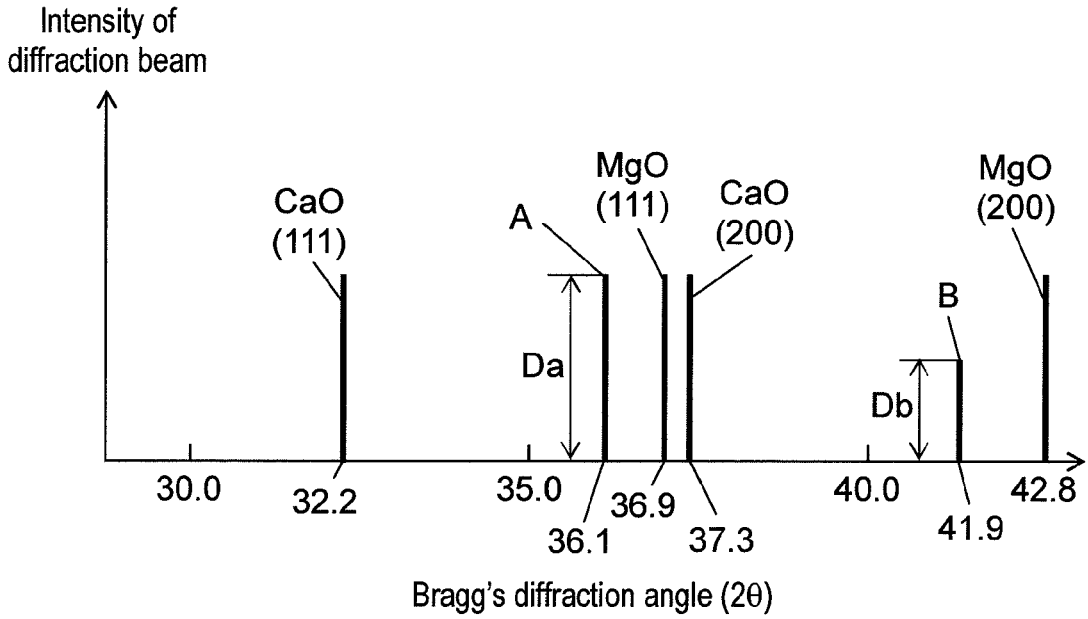
FIG. 3 shows the result of X-ray diffraction analysis on the protective layer of the PDP.

FIG. 3 shows the result of X-ray diffraction analysis on the surface of protective layer 9 of PDP 1, and the result thereof on simple chemical element of MgO and that of CaO. In FIG. 3, the horizontal axis represents Bragg's diffraction angle (2θ), and the vertical axis represents the intensity of X-ray diffracting wave. A unit of diffraction angle is expressed with a degree of one round represented by 360°, and the intensity thereof can be described arbitrarily. Each orientation of crystal plane is written in parentheses in FIG. 3, which shows that the diffraction angle on (111) plane of simple chemical element of CaO has a peak at 32.2 degrees, and that of simple chemical element of MgO on (111) plane has a peak at 36.9 degrees.

In a similar way, the diffraction angle on (200) plane of simple chemical element of CaO has a peak at 37.3 degrees and that of simple chemical element of MgO on (200) plane has a peak at 42.8 degrees.

On the other hand, protective layer 9 is formed by the thin-film deposition method using the pellets made of simple chemical element of MgO or CaO, or the pellets made by mixing these elements. This protective layer 9 undergoes the X-ray diffraction analysis, and the results are shown at points A and B in FIG. 3.

As shown in FIG. 3, the result of the X-ray diffraction analysis on the metal oxide of protective layer 9 shows peaks at point A (36.1 degrees) and point B (41.9 degrees). In other words, the metal oxide is oriented along both of (111) crystal plane and (200) crystal plane. In this case, intensity Da at peak point A of (111) plane should be greater than intensity Db at peak point B of (200) plane.

To be more specific, the diffraction angle on (111) plane of the metal oxide of protective layer 9 has a peak at 36.1 degrees, i.e. point A, which locates between the diffraction angles of MgO and CaO, both are simple chemical elements. The diffraction angle on (200) plane of the metal oxide of protective layer 9 has a peak at 41.9 degrees, i.e. point B, which locates between the diffraction angles of MgO and CaO, both are simple chemical elements.

The energy level of the metal oxide having the foregoing results of X-ray diffraction analysis is present between the energy levels of MgO and CaO, both are simple chemical elements. As a result, protective layer 9 exerts better secondary emission characteristics than the simple chemical element of MgO, so that in a case where a partial pressure of Xe working as discharge gas is increased in order to boost the brightness, the discharge voltage can be lowered, and yet a higher brightness of PDP driven with a lower voltage is achievable.

Figure 4:
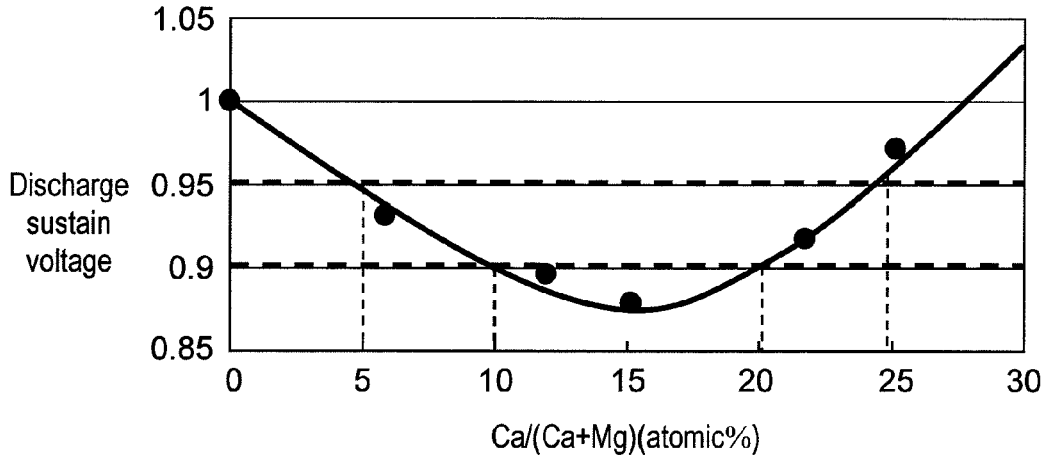
FIG. 4 shows relations between the density of Calcium (Ca) in the metal oxide of the protective layer of the PDP and a discharge sustain voltage of the PDP.

FIG. 4 shows relations between the density of calcium (Ca) of the metal oxide of protective layer 9 formed of CaO and MgO and the discharge-sustain voltage of PDP 1. The density of CaO is estimated from a peak-shifting range during the X-ray diffraction analysis on the calcium (Ca) component and magnesium (Mg) component contained in the metal oxide, and then the density of Ca is expressed with atomic %. The discharge voltage on the vertical axis is measured based on protective layer 9 formed of MgO only. The discharge-sustain voltage is measured in the mixed gas of Xe and Ne, where the partial pressure of Xe takes 15%.

As FIG. 4 explicitly shows, the discharge-sustain voltage of PDP 1 varies in response to the density of Ca in the metal oxide of protective layer 9. To be more specific, a greater density of Ca tends to lower the discharge-sustain voltage in comparison with protective layer 9 formed of MgO only, and when the density exceeds a given level, the discharge-sustain voltage tends to increase. When the density of Ca is within a range of 5 atomic %-25 atomic %, the discharge-sustain voltage can be reduced by 5% or more than 5% in comparison with PDP 1 having protective layer 9 made of MgO only.

On the other hand, when the density of Ca is within a range of 10 atomic %-20 atomic %, the discharge-sustain voltage can be further reduced by 10% or more than 10% in comparison with PDP 1 having protective layer 9 made of MgO only.

As a result, in a case where a mixed gas of Xe and Ne is used as a discharge gas, a partial pressure of Xe is raised for increasing the brightness, and the accompanying rise in the discharge-sustain voltage can be reduced by protective layer 9 in accordance with the embodiment of the present invention. PDP 1 having a higher brightness and yet driven with a lower voltage is thus obtainable.

Figure 5:
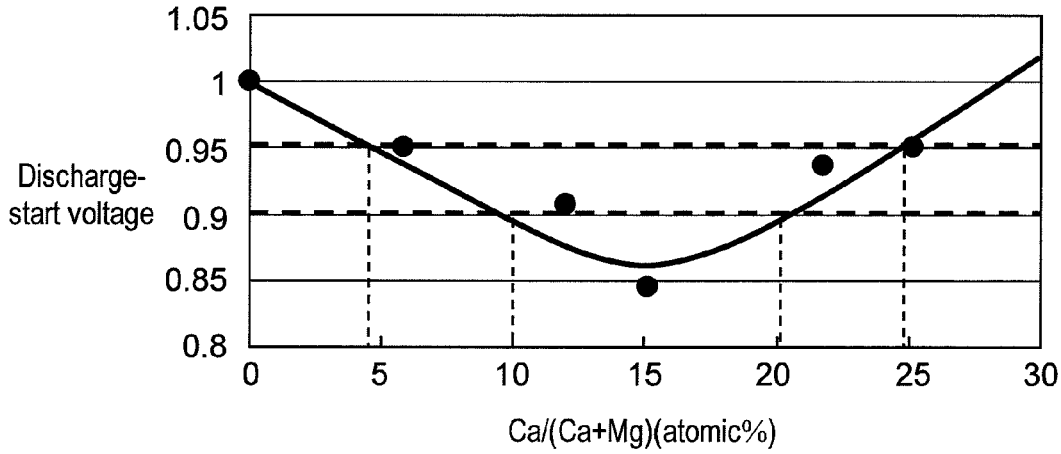
FIG. 5 shows relations between the density of Calcium (Ca) in the metal oxide of the protective layer of the PDP and a discharge start voltage of the PDP.

FIG. 5 shows the relations between the density of Ca in the metal oxide of protective layer 9 formed of MgO, CaO and the discharge-start voltage of PDP 1. As FIG. 5 explicitly shows, the discharge-start voltage shows a tendency similar to that of the discharge-sustain voltage. When the density of CaO is within a range of 5 atomic %-25 atomic %, the discharge-start voltage can be reduced by 5% or more than 5% in comparison with PDP 1 having protective layer 9 made of MgO only.

On the other hand, when the density of Ca is within a range of 10 atomic %-20 atomic %, the discharge-start voltage can be further reduced by 10% or more than 10% in comparison with PDP 1 having protective layer 9 made of MgO only.

The reason why protective layer 9 in accordance with this embodiment can lower its discharge-sustain voltage is due to a band structure of each one of the metal oxides. To be more specific, a depth of the valence band of CaO from the vacuum level is present in a shallower region in comparison with that of MgO. When electrons existing at the energy level of CaO transit to the ground state of Xe ions, a greater number of electrons can be emitted due to Auger effect than in the case of MgO.

Protective layer 9 in accordance with this embodiment is chiefly made of MgO and CaO, and when protective layer 9 undergoes X-ray diffraction analysis, a peak exists between the diffraction angles of the MgO and the CaO, both are simple chemical elements.

The foregoing metal oxide film has an energy level having properties synthesized with those of MgO and CaO. The energy level of protective layer 9 is thus present between those of MgO and CaO, both are simple chemical elements. Other electrons thus can obtain so high energy level due to Auger effect that the electrons can be emitted exceeding the vacuum level. As a result, protective layer 9 exerts the secondary emission characteristics better than that of simple chemical element of MgO, so that the discharge-sustain voltage can be lowered.

The simple chemical element of CaO is ready to react with impurities, so that the electron emission performance is lowered. However, the metal oxide formed of MgO and CaO allows lowering the reactivity of CaO for overcoming this problem.

The energy levels of SrO and BaO are present at a shallower region from the vacuum level than that of MgO, so that CaO can be replaced with SrO or BaO with the same advantage maintained.

On top of that, protective layer 9 in accordance with this embodiment is chiefly made of CaO and MgO, and the X-ray diffraction analysis on protective layer 9 discloses that the peak exists between the diffraction angles of these two chief materials (both are simple chemical elements). Protective layer 9 is thus formed of crystal structure having little impurities mixed, and a rare oxygen deficiency. As a result, an excess emission of electrons can be suppressed when the PDP is driven. Both of lower voltage driving and excellent secondary emission characteristics can be thus achieved, and on top of that, appropriate electric-charge retaining performance can be obtained advantageously. This electric-charge retaining performance is needed for retaining the wall charges stored during the initializing period in order to carry out the address discharge positively by preventing defective addresses during the address period.

Aggregated particle 92 provided on protective layer 9 and formed by aggregating multiple crystal particles 92*a* of MgO is detailed hereinafter. Experiments done by the inventors of the present invention prove that aggregated particle 92 produces the following two advantages: (1) suppressing discharge-delay in address discharge, and (2) improving the temperature dependence of the discharge-delay. To be more specific, aggregated particle 92 has primary-electron emission characteristics more excellent than that of protective layer 9. In this embodiment aggregated particle 92 is thus used as a primary-electron supplier which is needed when a discharge pulse rises.

At the start of discharge, a primary electron, which triggers the discharge, emits from the surface of protective layer 9 into discharge space 16. Shortage of amount of the primary electrons chiefly causes the discharge-delay. Aggregated particles 92 of MgO are thus dispersed on the surface of protective layer 9 in order to supply the primary electrons steadily. This structure allows a good supply of the primary electrons for eliminating the discharge-delay. This primary-electron emission characteristic thus allows a high-speed driving of excellent discharge-responsiveness even if PDP 1 is of high definition display. Aggregated particles 92 of MgO are dispersed on the surface of protective layer 9, and this structure chiefly produces an advantage that the discharge-delay during the address discharge can be prevented, and on top of that, the temperature dependency of discharge-delay can be also improved.

As discussed above, PDP 1 in accordance with the embodiment of the present invention includes protective layer 9 which can produce the following two advantages simultaneously for PDP 1: (1) PDP 1 can be driven with a lower voltage, and (2) PDP 1 has electric-charge retaining characteristics. PDP 1 also includes aggregated particles 92 of MgO, for preventing the discharge-delay. This structure allows PDP 1 of high definition display to be driven with a lower voltage, and achieving a quality picture by suppressing the defective lightings.

Figure 6:
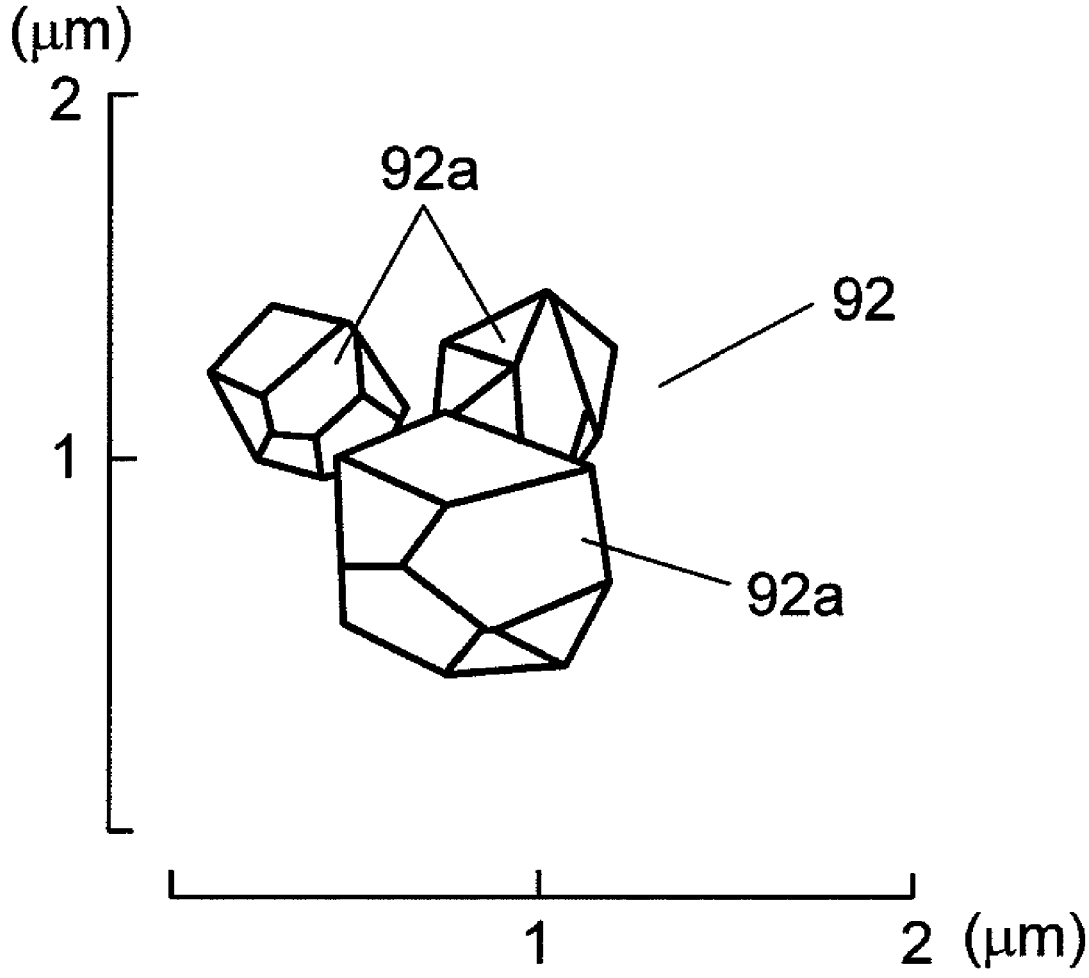
FIG. 6 shows an enlarged view of an aggregated particle of the PDP.

FIG. 6 shows aggregated particle 92*a* enlarged for the description purpose. Particle 92*a* is provided on protective layer 9 of PDP 1. As shown in FIG. 6, primary particles having given diameters are aggregated into aggregated particle 92. In other words, aggregated particle 92 is not formed by bonding the particles 92*a* together like a solid body with great bonding, force, but the multiple primary particles 92*a* simply form an aggregate with static electricity or van der Waals force. Thus parts of or all of the aggregated particle 92 gather one another as weak as they turned into primary particles by external stimulus, such as an ultrasonic wave. Aggregated particle 92 is thus formed. The particle diameter of aggregated particle 92 is approx. 1 μm, and crystal particle 92*a* desirably forms a polyhedral shape having seven faces or more than seven faces such as 14 faces or 12 faces.

The particle diameter of the primary particle can be controlled depending on a manufacturing condition of crystal particles 92*a*. For instance, when crystal particles 92*a* are formed by firing the MgO precursor, e.g. magnesium carbonate or magnesium hydroxide, the firing temperature or the firing atmosphere is controlled, whereby the particle diameter can be controlled. In general, the firing temperature can be selected from the range of 700-1500° C. A rather higher firing temperature over 1000° C. allows the diameter of the primary particle to be within the range of 0.3-2 μm. Crystal particle 92*a* can be obtained by heating the precursor of MgO, and during its production steps, multiple primary particles are aggregated together, whereby aggregated particle 92 can be obtained.

Figure 7:
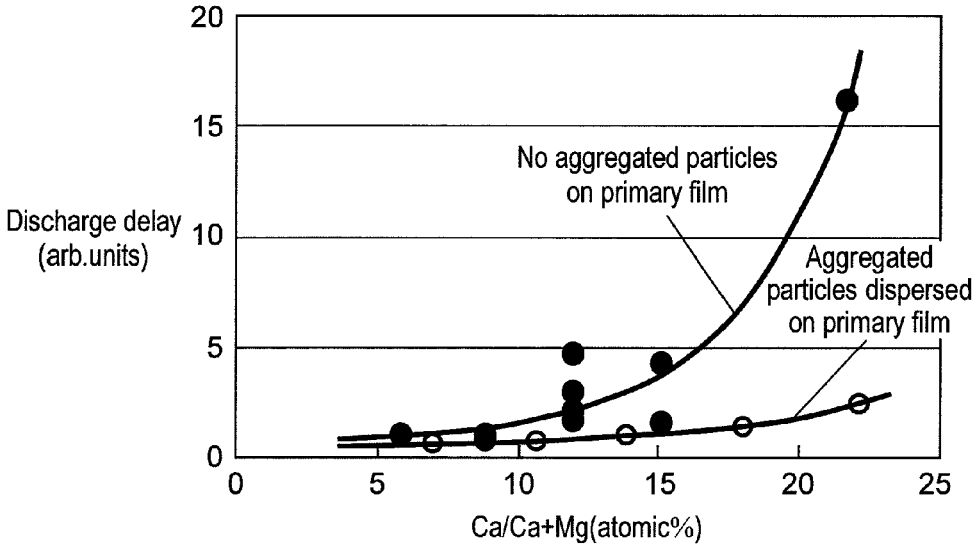
FIG. 7 shows relations between a discharge delay of the PDP and the density of the calcium in the protective layer.

FIG. 7 shows the relation between the discharge-delay of PDP 1 and the density of Ca contained in protective layer 9, which includes the metal oxide formed of MgO and CaO. On top of that, the metal oxide has the following characteristics: X-ray diffraction analysis on the surface of protective layer 9 reveals that the metal oxide has a peak between a diffraction angle where a peak of MgO occurs and a diffraction angle where a peak of CaO occurs.

FIG. 7 shows the following two cases: (1) Protective layer 9 is formed of primary film 91 only, and (2) protective layer 9 is formed of primary film 9 on which aggregated particles 92 are dispersed. The reference value of the discharge delay is measured on primary film 91 not containing Ca.

The electron emission performance is expressed with a numeral indicating that a greater numeral shows a greater amount of electron emission, and the numeral is expressed with a primary electron emission amount which is determined by the surface condition and the type of gas. The emission amount of the primary electrons can be measured this way: Irradiate the surface of protective layer 9 with ions or an electron beam, and measure an amount of electron current emitted from the surface. However, it is difficult to evaluate the surface of the front panel of PDP by the non-destructive inspection method, so that the inventors use the method disclosed in the Unexamined Japanese Patent Application Publication No. 2007-48733. To be more specific, find a numeral called as statistical delay-time which can be a guideline of easiness of discharge occurrence, and then integrate the reciprocal of the numeral. The resultant numeral corresponds linearly to the emission amount of the primary electrons. This resultant numeral is used for the evaluation. A delay time at a discharge indicates a time lag between a rise of a pulse and a start of a discharge. This discharge-delay is chiefly caused by the fact that the primary electrons, which are supposed to trigger the discharge, cannot emit easily from the surface of the protective layer.

As FIG. 7 explicitly shows, in the case where protective layer 9 is formed of primary film 91 only, the discharge-delay becomes greater at the higher density of Ca. On the other hand, in the case where protective layer 9 is formed of primary film 91 on which aggregated particles 92 are dispersed, the discharge-delay becomes substantially smaller, and a higher density of Ca invites little increase in the discharge-delay.

Figure 8:
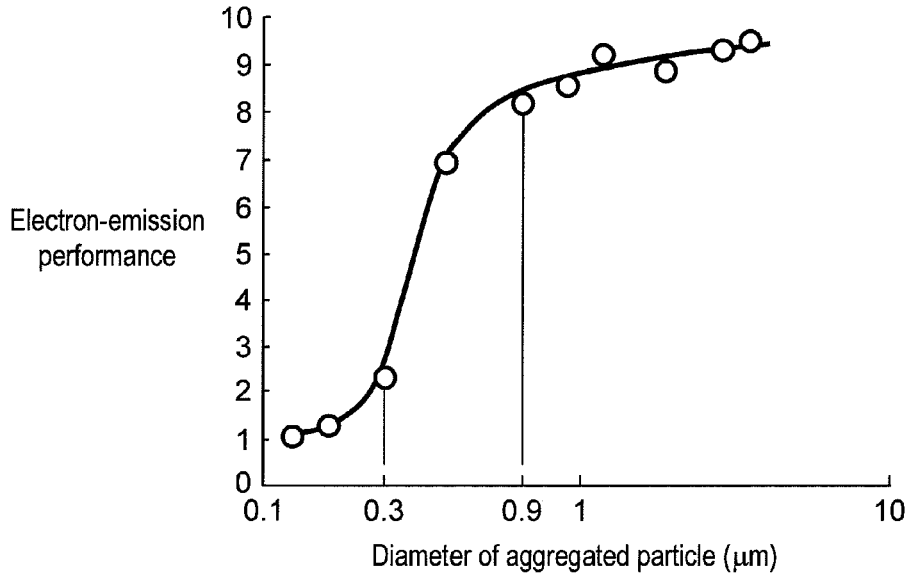
FIG. 8 shows the result of the experiment where diameters of the crystal particles are varied for testing the electron emission performance of the PDP.

Next, a diameter of crystal particle 92*a* used in protective layer 9 of PDP 1 in accordance with this embodiment is described hereinafter. A diameter of a particle refers to an average diameter, which means a cumulative volumetric average diameter (D50). FIG. 8 shows an experimental result of examining the electron emission performance by varying the particle diameter of aggregated particle 92. In FIG. 8, the diameter of aggregated particle 92 is measured by viewing the sectional SEM photo. As shown in FIG. 8, the electron emission performance lowers in a region where a diameter of particle 92 decreases to as small as 0.3 μm, and it can be kept in a high level in a region where the diameter exceeds 0.9 μm.

To increase the number of electrons emitted within a discharge cell, it is preferable that a larger number of crystal particles 92*a* exist at a unit area on protective layer 9. However, the experiment done by the inventors of the present invention proves this fact: Presence of crystal particles 92*a* at the top of barrier rib 14, with which protective layer 9 closely contacts, damages the top of barrier rib 14, and then the material of rib 14 is on phosphor layer 15, so that the cell encountering this problem cannot normally turn on or off. This damage of barrier rib 14 resists occurring when crystal particle 92*a* does not exist at the top of barrier rib 14, so that a larger number of crystal particles 92*a* will increase the occurrence of damages in barrier ribs 14. The probability of the damage sharply increases when the diameter of crystal particle 92*a* increases to as large as 2.5 μm; however, it stays at a rather low level when the diameter is not greater than 2.5 μm. The result proves that the use of aggregated particle 92, of which particle diameters are within a range from 0.9 μm to 2.5 μm, can produce the foregoing advantages.

As discussed above, the present invention can provide PDP 1 having the following two advantages: higher electron-emission performance, and electric-charge retaining performance of V-scn lighting voltage not greater than 120V.

In this embodiment, MgO particles are used as crystal particles; however, other single-crystal particles of the materials having excellent electron-emission performance similar to that of MgO, such as SrO, CaO, BaO or $Al_2O_3$, can be used, and the use of crystal particles of those metal oxides allows producing advantages similar to what are discussed previously. The material of the particles is thus not limited to MgO only.

INDUSTRIAL APPLICABILITY

The present invention is useful for achieving a PDP that can display a quality video and yet consume a smaller electric power.

Description Of Reference Signs

1 PDP
2 front panel
3 front glass substrate
4 scan electrode
4*a*, 5*a* transparent electrode
4*b*, 5*b* metal bus electrode
5 sustain electrode
6 display electrode
7 black strip (light proof layer)
8 dielectric layer
9 protective layer
10 rear panel
11 rear glass substrate
12 address electrode
13 primary dielectric layer
14 barrier rib
15 phosphor layer
16 discharge space
81 first dielectric layer
82 second dielectric layer
92 aggregated particle
92*a* crystal particle

The invention claimed is:

1. A plasma display panel comprising:
a first substrate including;
a display electrode formed on a board;
a dielectric layer covering the display electrode; and
a protective layer formed on the dielectric layer; and
a second substrate disposed facing the first substrate, such that a discharge space is formed between the first substrate and the second substrate,
wherein the discharge space is filled with a discharge gas,
wherein the second substrate includes an address electrode formed along a direction intersecting the display electrode,
wherein the second substrate includes a barrier rib partitioning the discharge space,
wherein the protective layer is formed of a metal oxide comprised of magnesium oxide (MgO) and calcium oxide (CaO) having a structure such that an X-ray diffraction analysis on a surface of the protective layer indicates that the metal oxide has a peak between a diffraction angle where a peak of the MgO occurs and a diffraction angle where a peak of the CaO occurs along an identical orientation of the peak of the MgO,
wherein a density of calcium of the metal oxide is within a range between 5 atomic % and 25 atomic % inclusive, and
wherein the metal oxide has a peak indicating a crystal orientation of a (111) plane.

2. The plasma display panel of claim 1, wherein the density of the calcium in the metal oxide is within a range between 10 atomic % and 20 atomic % inclusive.

3. The plasma display panel of claim 1, wherein an aggregated particle formed of a plurality of crystal particles of MgO is attached to the protective layer at a surface facing the discharge space.

* * * * *